US010601153B2

(12) United States Patent
Maki

(10) Patent No.: US 10,601,153 B2
(45) Date of Patent: Mar. 24, 2020

(54) COAXIAL CONNECTOR ASSEMBLY

(71) Applicant: HIROSE ELECTRIC CO., LTD., Tokyo (JP)

(72) Inventor: Kentaro Maki, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/007,997

(22) Filed: Jun. 13, 2018

(65) Prior Publication Data

US 2018/0366843 A1 Dec. 20, 2018

(30) Foreign Application Priority Data

Jun. 16, 2017 (JP) ..... 2017-118505

(51) Int. Cl.

| | |
|---|---|
| ***H01R 12/00*** | (2006.01) |
| ***H01R 9/05*** | (2006.01) |
| ***H01R 13/631*** | (2006.01) |
| ***H01R 13/639*** | (2006.01) |
| ***H01R 13/11*** | (2006.01) |
| ***H01B 11/18*** | (2006.01) |
| ***H01R 24/42*** | (2011.01) |
| ***H01R 24/44*** | (2011.01) |
| ***H01R 13/627*** | (2006.01) |
| *H01R 13/436* | (2006.01) |

(52) U.S. Cl.

CPC ..... *H01R 9/0503* (2013.01); *H01B 11/18* (2013.01); *H01R 13/111* (2013.01); *H01R 13/6272* (2013.01); *H01R 13/639* (2013.01); *H01R 13/6315* (2013.01); *H01R 24/42* (2013.01); *H01R 24/44* (2013.01); *H01R 9/0518* (2013.01); *H01R 13/4361* (2013.01)

(58) Field of Classification Search

CPC ..... H01R 2103/00; H01R 13/65802
USPC ..... 439/63, 579, 580–582, 607.01, 675
See application file for complete search history.

(56) References Cited

U.S. PATENT DOCUMENTS 4,412,717 A * 11/1983 Monroe ..... H01R 9/0518 439/581
4,598,961 A * 7/1986 Cohen ..... H01R 24/50 439/581

(Continued)

FOREIGN PATENT DOCUMENTS

JP 64019277 U 1/1989
JP 3011671 B2 2/2000

*Primary Examiner* — Thanh Tam T Le
(74) *Attorney, Agent, or Firm* — Rankin, Hill & Clark LLP

(57) ABSTRACT

A coaxial connector assembly including a plug connector and a receptacle connector each holding a coaxial terminal including a center and an external terminal surrounding the center terminal, wherein housings of the plug connector and the receptacle connector have an engageable/disengageable lock mechanism, in an engagement state, a range of relative movement between the coaxial terminals in an axial direction is smaller than a shorter one of a center terminal effective fitting length, which is a distance from a start position to an end position of contact between the center terminals, or an external terminal effective fitting length, which is a distance from a start position to an end position of contact between the external terminals, and an impedance in the axial direction range of the minimum effective fitting length is matched to a specific impedance.

20 Claims, 7 Drawing Sheets

(56) References Cited

U.S. PATENT DOCUMENTS

| | | | | | |
|---|---|---|---|---|---|
| 4,619,496 | A * | 10/1986 | Forney, Jr. | H01R 24/40 | 439/434 |
| 5,842,872 | A * | 12/1998 | Hosler, Sr. | H01R 24/50 | 439/63 |
| 6,045,402 | A * | 4/2000 | Embo | H01R 24/50 | 439/561 |
| 6,386,888 | B1 * | 5/2002 | Skopic | H01R 24/50 | 439/581 |
| 6,663,397 | B1 * | 12/2003 | Lin | H01R 13/6277 | 439/154 |
| 7,014,503 | B1 * | 3/2006 | Wang | H01R 24/005 | 439/541.5 |
| 7,029,286 | B2 * | 4/2006 | Hall | H01R 13/506 | 439/357 |
| 7,150,648 | B1 * | 12/2006 | Hall | H01R 24/50 | 439/581 |
| 8,430,675 | B2 * | 4/2013 | Hardy | H01R 24/50 | 439/607.36 |
| 8,932,079 | B2 * | 1/2015 | Marsh | H01R 9/0503 | 439/585 |

* cited by examiner

COAXIAL CONNECTOR ASSEMBLY

CROSS-REFERENCE TO RELATED APPLICATION

This application claims priority from Japanese Patent Application No. 2017-118505 filed with the Japan Patent Office on Jun. 16, 2017, the entire content of which is hereby incorporated by reference.

BACKGROUND

1. Technical Field

The present disclosure relates to a coaxial connector assembly.

2. Related Art

A coaxial connector includes a coaxial terminal having a center terminal connected to a core wire of a coaxial cable and an external terminal connected to a shield wire of the coaxial cable and surrounding the center terminal. It has been demanded for the coaxial terminal to suppress electromagnetic leakage from the external terminal to the center terminal. In addition, it has been demanded that a distance between the center terminal and the external terminal is set such that a specific impedance is generated at any position of a fitting portion in a connector fitting state, considering a permittivity between the center terminal and the external terminal.

Japanese Patent No. 3011671 proposes, for ensuring such impedance properties, a specific impedance (1/ve)×log(D/d) at an optional position in an axial direction range of an effective fitting length upon contact between center terminals and between external terminals in a fitting state between a plug connector and a receptacle connector is set constant when the outer diameter of the center terminal is d, the inner diameter of the external terminal is D, and a permittivity between the center terminal and the external terminal is e. A coaxial connector assembly of Japanese Patent No. 3011671 is based on an assumption that the plug connector (a plug) and the receptacle connector (a jack) employs a one-touch slide-in (snap-in) technique. According to Japanese Patent No. 3011671, when both connectors are in a predetermined fitting state in an axial direction as a connector fitting direction, if both connectors move, in the axial direction, relative to each other by a clearance generated between the connectors in the axial direction, the above-described specific impedance can be maintained.

In the one-touch slide-in technique employed for the coaxial connector assembly of Japanese Patent No. 3011671, in a state in which both connectors form a single axis and connection between the center terminals and between external terminals is made, the tubular external terminals of both connectors are slidably fitted together in the axial direction as disclosed as, e.g., a snap-in technique in JP-UM-A-64-019277. In this manner, both connectors are locked at a predetermined fitting position. For such locking, an annular groove configured such that a sectional shape in a plane perpendicular to the axis is a V-shape is provided at one of tubular fitting surfaces of both external terminals, and an annular protrusion to be engaged with the annular groove is provided at the other fitting surface. Thus, when both external terminals slide relative to each other to the predetermined fitting position, the annular protrusion is locked in the annular groove. With this configuration, both connectors have the function of suppressing connector detachment.

SUMMARY

A coaxial connector assembly according to the present disclosure include a plug connector and a receptacle connector each configured to hold, at a housing of an electric insulating material, a coaxial terminal including a center terminal of a coaxial cable and an external terminal surrounding the center terminal, wherein, at least one of the plug connector or the receptacle connector is a cable connector, the housing of the plug connector and the housing of the receptacle connector have an engageable/disengageable lock mechanism at a predetermined fitting position between the housings, in an engagement state, a range of relative movement between the coaxial terminals in an axial direction as a coaxial terminal insertion/detachment direction is smaller than a minimum effective fitting length, the minimum effective fitting length is a shorter one of a center terminal effective fitting length or an external terminal effective fitting length, the center terminal effective fitting length is a distance from a start position of contact between the center terminals at a start of fitting between the coaxial terminals to an end position of contact between the center terminals at an end of fitting between the coaxial terminals, the external terminal effective fitting length is a distance from a start position of contact between the external terminals at the start of fitting between the coaxial terminals to an end position of contact between the external terminals at the end of fitting between the coaxial terminals, and an impedance in the axial direction range of the minimum effective fitting length is matched to a specific impedance.

DESCRIPTION OF THE EMBODIMENTS

Figure 1:
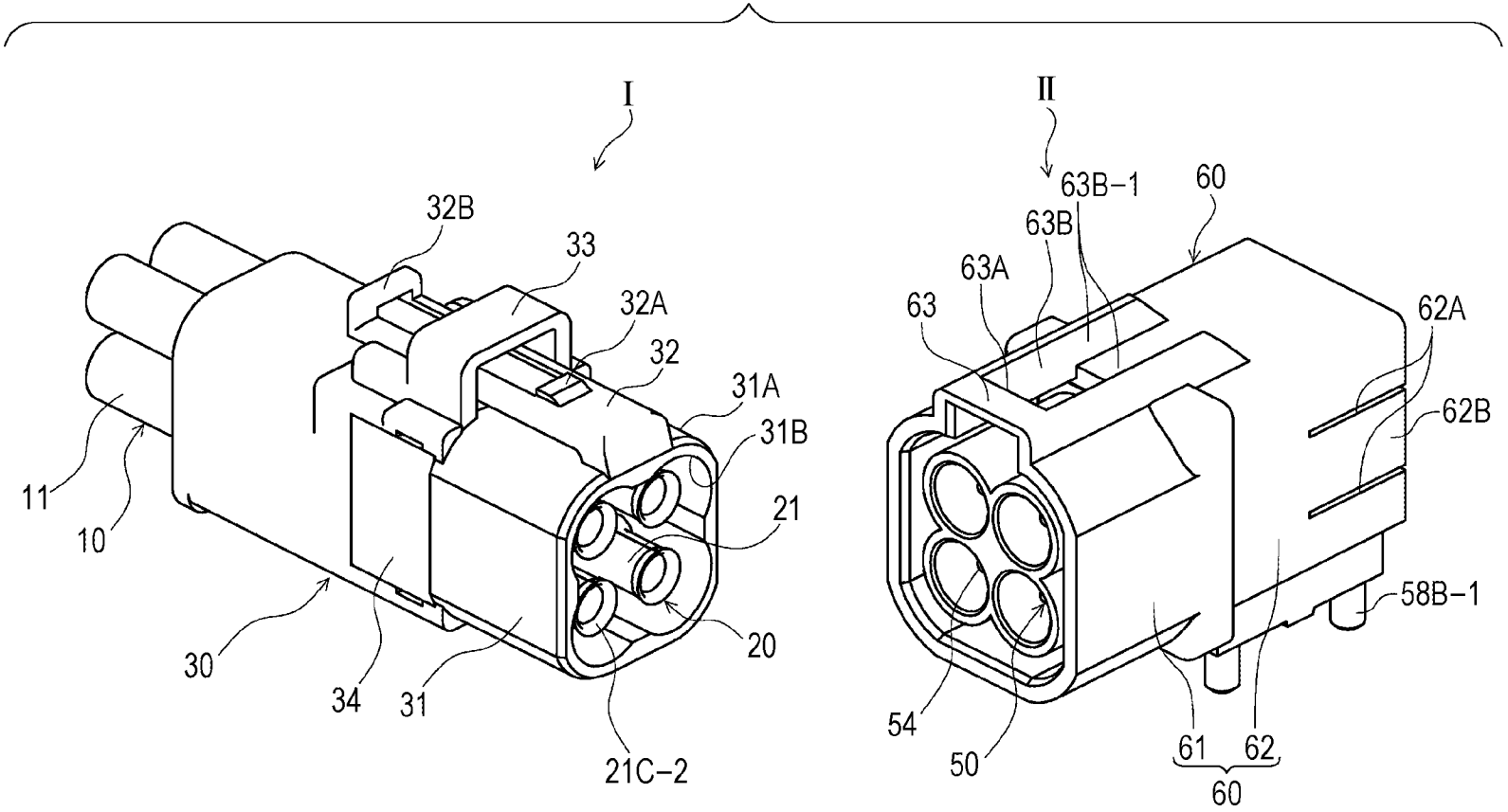
FIG. 1 is a perspective view of states of outer appearances of a plug connector and receptacle connectors included in a coaxial connector assembly of the present disclosure before fitting connection.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the above-described coaxial connector having the center terminal and the external terminal, measures to suppress detachment by the snap-in technique between the tubular external terminals are taken. However, the V-shaped annular protrusion and annular groove are locked together, and therefore, the annular protrusion and the annular groove run on each other along V-shaped inclined surfaces thereof and are detached from each other when unintended great external force acts in a detachment direction. Moreover, in JP-UM-A-64-019277, slits extending in the axial direction are, for snap-in fitting, formed at multiple circumferential positions of one of the external terminal. This allows elastic diameter expansion upon snap-in. Thus, there is a probability that electromagnetic leakage through the slits is caused. For this reason, a heat-shrinkable conductive tube is, as countermeasures, fitted onto two external terminals fitted together, thereby suppressing electromagnetic leakage through the slits as described above. In addition, suppression of detachment of the terminals on both sides is enhanced to a certain extent.

However, even in this technique, a heat shrinkage effect cannot be expected as long as the conductive tube is not a relatively-thin tube. Moreover, coupling strength in the axial direction is not sufficient. Further, it is demanded for the connectors that the external terminals can be disengaged, i.e., detached, from each other in an intended predetermined situation. In this state, the conductive tube needs to be broken. As a result, extreme inconvenience is caused in the case of repeating insertion/detachment of the connectors in an intended manner.

For these reasons, for full lock without relying on the external terminals upon connector coupling, a disengageable lock mechanism needs to be provided at the housings holding the external terminals. In a general connector lock mechanism, an elastic arm with a stop is provided at one of the housings, and another stop to be locked at the above-described stop is provided at the other housing. With this configuration, the elastic arm generates elastic deflection according to the principle of leverage upon connector fitting. The stop provided at the elastic arm moves over another stop of the partner connector, and then, these stops are locked together in the axial direction. This suppresses detachment of the housings from each other as long as disengagement force is applied to the elastic arm in an intended manner. This leads to so-called "full lock."

However, when this full lock technique is employed for the coaxial connector, another problem is newly caused. For this full lock technique, locking using the stops and generation of elastic deflection by the elastic arm for unlocking are necessary. Thus, a clearance allowing relative movement between the housings in the axial direction within a limited range is provided such that no interference such as collision or friction is caused between the stops upon locking or unlocking. In a case where at least one of two connectors fitted together is a cable connector, when the external force of pulling the cable acts on the cable, both connectors move relative to each other in the above-described clearance. Thus, there is a probability that the coaxial terminals of the coaxial connectors are shifted relative to each other in the axial direction in the connector fitting state by the sum of the above-described clearance and backlash in the axial direction upon assembly of the external terminal and the housing. Such shift might influence the above-described specific impedance.

In view of the above-described situation, the present disclosure is intended to maintain, in a coaxial connector assembly, a specific impedance while realizing deactivatable full lock.

A coaxial connector assembly according to an embodiment of the invention includes a plug connector and a receptacle connector each configured to hold, at a housing of an electric insulating material, a coaxial terminal including a center terminal of a coaxial cable and an external terminal surrounding the center terminal, wherein at least one of the plug connector or the receptacle connector is a cable connector.

The coaxial connector assembly, in the embodiment, the housing of the plug connector and the housing of the receptacle connector have an engageable/disengageable lock mechanism at a predetermined fitting position between the housings, in an engagement state, a range of relative movement between the coaxial terminals in an axial direction as a coaxial terminal insertion/detachment direction is smaller than a minimum effective fitting length, the minimum effective fitting length is a shorter one of a center terminal effective fitting length or an external terminal effective fitting length, the center terminal effective fitting length is a distance from a start position of contact between the center terminals at a start of fitting between the coaxial terminals to an end position of contact between the center terminals at an end of fitting between the coaxial terminals, the external terminal effective fitting length is a distance from a start position of contact between the external terminals at the start of fitting between the coaxial terminals to an end position of contact between the external terminals at the end of fitting between the coaxial terminals, and an impedance in the axial direction range of the minimum effective fitting length is matched to a specific impedance.

According to such a configuration, the housings of both connectors have the lock mechanism. Thus, the so-called "full lock" deactivatable only in an intended situation is realized. In addition, the impedance between the coaxial terminals of both connectors is matched to the specific impedance in the axial direction range of the minimum effective fitting length. Moreover, the range of relative movement between the coaxial terminals in the axial direction is smaller than the minimum effective length. Thus, even when both coaxial connectors move relative to each other in the above-described relative movement range in the lock state, matching to the specific impedance as described above is ensured.

In the embodiment, the external terminal of the coaxial terminal in one connector of the plug connector or the receptacle connector has a first external contact portion, the first external contact portion has a smaller diameter than a diameter of the external terminal in an axial area of the external terminal corresponding to a center contact portion of the center terminal, and extends toward the coaxial terminal in the other connector of the plug connector or the receptacle connector from the corresponding area, the external terminal of the coaxial terminal of the other connector has a second external contact portion, the other contact portion has a smaller diameter than a diameter of an exterior base portion fitted onto a dielectric body, and extends to a middle position of the center terminal in the axial direction, and the center terminal of the coaxial terminal of the other connector is formed such that a diameter of the center contact portion protruding toward the coaxial terminal of the one connector with respect to the external terminal in the axial direction is greater than a diameter of a portion surrounded by the external contact portion of the coaxial terminal of the other connector.

With such a configuration, matching to the specific impedance in the axial direction range of the minimum effective fitting length can be realized.

In the embodiment, the range of relative movement between the coaxial terminals is a sum of a clearance between the housings in the axial direction in a connector lock state and backlash in the axial direction between each housing and the corresponding external terminal.

With such a configuration, matching to the specific impedance is ensured even when the coaxial terminals move relative to each other in the axial direction in the lock state, considering an axial-direction clearance necessary for the lock mechanism and backlash inevitably generated between the housing and the external terminal of each connector.

In the present embodiment, the plug connector and the receptacle connector can be configured such that multiple coaxial terminals are housed. With this configuration, the housings of both connectors are fitted together such that multiple coaxial terminals are fitted and connected together at a time.

In the present embodiment, wherein the receptacle connector has a metal shield shell in the housing of the receptacle connector, the center terminal includes multiple center terminals, the dielectric body includes multiple dielectric bodies, and the external terminal includes multiple external terminals, the shield shell is formed to collectively house the center terminals, the dielectric bodies, and external terminals, and the shield shell is configured such that a connector fitting side portion thereof enters, in a fitting state between the receptacle connector and the plug connector, the housing of the plug connector to contact the external terminal of the plug connector.

In such a configuration, the shield shell can collectively shield multiple coaxial terminals. In this state, the single shield shell is preferably formed such that the coaxial terminals are separated from each other to be shielded respectively. For example, the shield shell may include a support tubular portion surrounding and supporting each external terminal of the receptacle connector in a separated state.

In the present embodiment, the plug connector may have a retainer configured to determine the position of each coaxial terminal. This leads to a constant distance between the coaxial terminals.

In the present embodiment, the housings of the coaxial connectors are, as described above, provided with the lock mechanism for deactivatable full lock. Moreover, in the fitting state necessary for full lock, the range of relative movement between the coaxial terminals in the axial direction is set smaller than the minimum effective fitting length as a shorter one of the center terminal effective fitting length or the external terminal effective fitting length. Further, in the axial direction range of the minimum effective fitting length, the impedance is matched to the specific impedance. Thus, full lock is ensured. In addition, even when the connectors in the fitting state move in the axial direction due to the clearance and the backlash as described above, the specific impedance is not influenced at all.

Hereinafter, a coaxial connector assembly as one embodiment of the present disclosure will be described with reference to the attached drawings.

FIGS. 1 and 5A to 5C are perspective views of the coaxial connector assembly of the present embodiment, the perspective views illustrating states of an outer appearance of a plug connector I and an outer appearance of a receptacle connector II included in the coaxial connector assembly before fitting connection.

In FIG. 1, the plug connector I collectively holds, at a substantially rectangular tubular housing 30 made of an electric insulating material, four coaxial terminal equipped cables 10 having coaxial terminals attached to coaxial cables. The coaxial cable described herein has, as conductors, a core wire and a shield wire. A center terminal is connected to the core wire. Moreover, an external terminal is connected to the shield wire surrounding the core wire. The center terminal and the external terminal form the coaxial terminal. In a state in which the coaxial terminal is connected, the core wire and the center terminal form a center conductor. Further, the shield wire and the external terminal form an external conductor.

Figure 2:
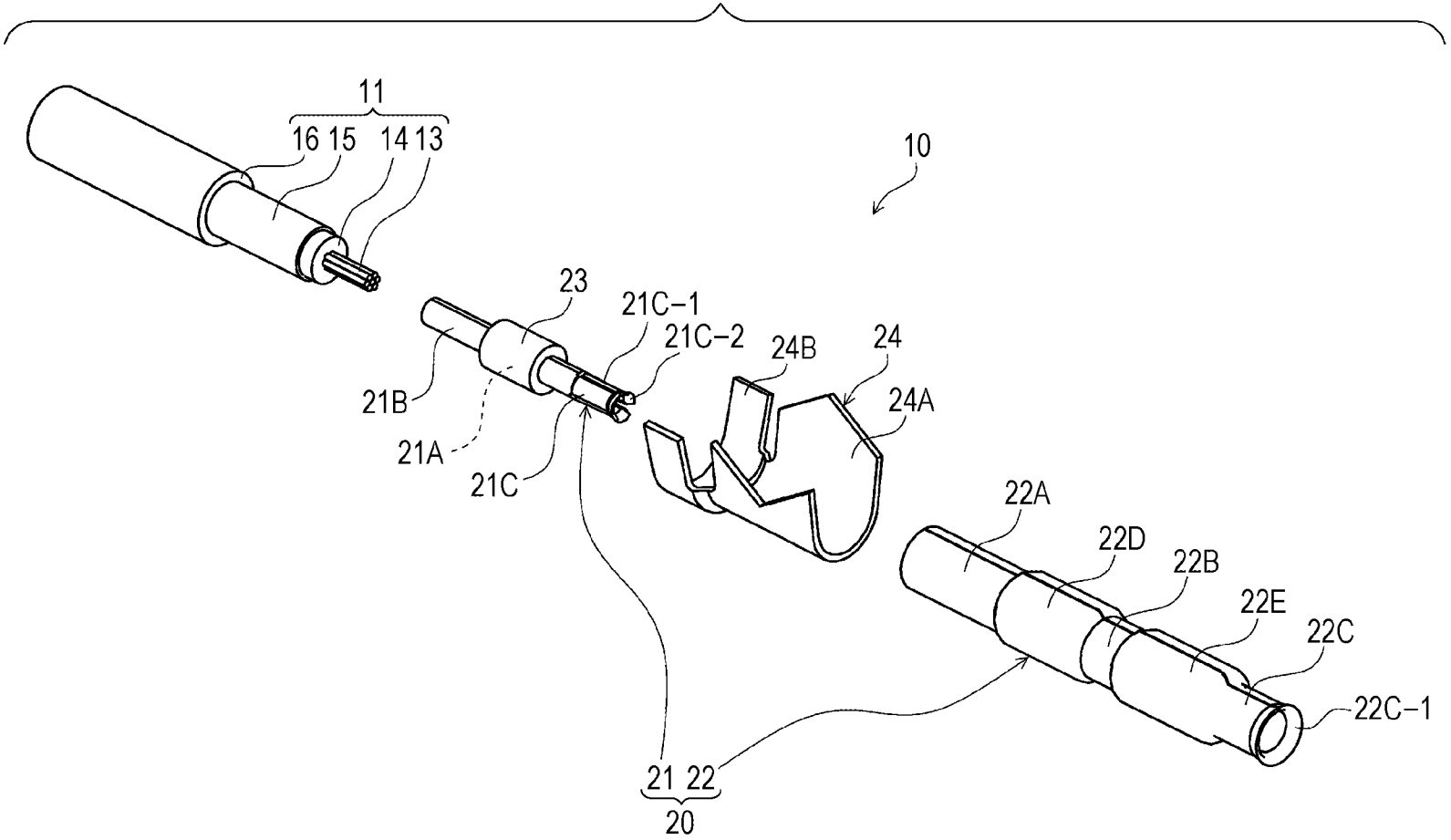
FIG. 2 is a perspective view of each of separated members of a coaxial terminal equipped cable, such as a coaxial cable, a center terminal, and an external terminal, used for the plug connector of FIG. 1.

In the state of FIG. 1, each coaxial terminal equipped cable 10 is formed such that the coaxial terminal 20 is attached to one end of the coaxial cable 11. The coaxial cable 11 itself includes, as seen from FIG. 2 illustrating a state before attachment of the coaxial terminal 20 to the coaxial cable 11, the core wire 13 as a twisted wire forming a cable portion of the center conductor, a dielectric body 14 surrounding the core wire 13, the shield wire 15 formed of a braid of metal thin wires surrounding the periphery of the dielectric body 14 and forming a cable portion of the external conductor, and an outer coat 16 of an insulating material covering the shield wire 15. Upon attachment of the coaxial terminal 20, the core wire 13, the dielectric body 14, and the shield wire 15 are exposed to protrude toward one end side in this order.

The coaxial terminal 20 is attached to the coaxial cable 11. As seen from FIG. 2, the coaxial terminal 20 has the center terminal 21 forming a terminal portion of the center conductor, and the external terminal 22 forming a terminal portion of the external conductor.

The center terminal 21 is obtained in such a manner that a metal band-shaped body is formed in a stepped substantially-cylindrical shape having a center axis along a longitudinal direction thereof and joining is performed for the formed metal band-shaped body. In FIG. 2, a joint line is positioned on an upper side. At the substantially cylindrical center terminal 21, a narrow diameter portion 21A is formed at a middle portion in an axial direction. At an outer peripheral surface of the narrow diameter portion 21A, a cylindrical dielectric body 23 with a greater diameter than those of other portions is held. The substantially cylindrical center terminal 21 has a center connection portion 21B and a center contact portion 21C. As seen from FIG. 2, the center connection portion 21B is, on a back side (in FIG. 2, the core wire 13 side in the axial direction) of the narrow diameter portion 21A, fitted and connected onto the core wire 13. The center contact portion 21C is formed across the entirety (a partner connector side) of the narrow diameter portion 21A, thereby receiving a center terminal of a partner connector. Hereinafter, in a front-to-back direction along the axial direction, a direction in which the plug connector I and the receptacle connector II approach each other is a front or a front portion. That is, for the plug connector I, a direction closer to the receptacle connector II is a front and a front portion. On the other hand, for the receptacle connector II, a direction closer to the plug connector I is a front and a front portion.

Figure 5B:
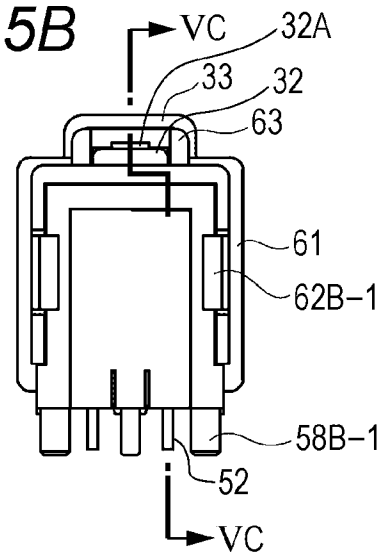
FIGS. 5A to 5C illustrate the coaxial connector assembly (a fitting connection state) of FIG. 1, FIG. 5A being a plan view, FIG. 5B being a side view, and FIG. 5C being a VC-VC sectional view of FIG. 5B and illustrating a state when the plug connector is at the most advanced position with respect to the receptacle connector.

The center connection portion 21B is connected to the core wire 13 by, for example, solder connection or pressure bonding. FIG. 5C illustrates an example of solder connection. In FIG. 5C, the core wire 13 is illustrated together with solder. Thus, a front end of the core wire 13 is illustrated thicker by the solder. On the other hand, in the center contact portion 21C, as seen from FIG. 2, slits 21C-1 penetrating a thickness direction (a radial direction) of the center contact portion 21C are, on a front end side thereof, formed to extend toward a front end at multiple positions in a circumferential direction. These multiple slits 21C-1 allow elastic diameter expansion of the center contact portion 21C. A front edge of the center contact portion 21C has a tapered introduction portion 21C-2 facilitating entrance of the partner center terminal.

As in the center terminal 21, the external terminal 22 is formed in such a manner that a metal band-shaped plate is shaped in a substantially cylindrical shape having a center axis along a longitudinal direction thereof. As seen from FIG. 2, a joint line extending in the axial direction is positioned on the upper side. The external terminal 22 has narrow diameter portions at back, middle, and front portions. The back portion forms an external connection portion 22A to be swaged by a later-described metal fastener 24 at the outer periphery of the shield wire 15 after the external connection portion 22A is inserted between the shield wire 15 and the dielectric body 14 of the coaxial cable 11. The middle portion forms a position determination portion 22B having an inner surface configured to contact an outer surface of the dielectric body 23 of the center terminal 21. The front portion forms an external contact portion 22C to be connected in contact with an external terminal of the later-described partner connector after having received such an external terminal. A tapered introduction portion 22C-1 facilitating entrance of the partner external terminal is formed at a front edge of the external contact portion 22C. A portion between the external connection portion 22A and the position determination portion 22B forms a back large diameter portion 22D. A portion between the position determination portion 22B and the external contact portion 22C forms a front large diameter portion 22E.

The external terminal 22 has, in the axial direction, the following position relationship with each portion 22A to 22E of the external terminal 22, each portion 21A to 21C of the center terminal 21, the dielectric body 23, and each portion 13 to 16 of the coaxial cable 11. Such a position relationship will be also described below with reference to FIG. 5C.

First, the external connection portion 22A is inserted between the dielectric body 14 and the exposed shield wire 15 of the coaxial cable 11, and is positioned in an exposed area of the shield wire 15 in the axial direction.

The back large diameter portion 22D is, in the axial direction, positioned in an area between a front end position of the dielectric body 14 of the coaxial cable 11 and a back end position of the dielectric body 23 attached to the narrow diameter portion 21A of the center terminal 21. Such an area is substantially equal to exposed areas of the core wire 13 and the center connection portion 21B.

The position determination portion 22B is, in the axial direction, positioned in the area of the dielectric body 23 attached to the center terminal 21. The position determination portion 22B forms an annular groove portion between the back large diameter portion 22D and the front large diameter portion 22E positioned in the front and back of the position determination portion 22B. Each of later-described retainers enters, from the circumferential direction (a tangential direction), toward the position determination portion 22B forming the annular groove portion, thereby determining the position of the external terminal 22 in the radial direction and the axial direction. As described above, the position determination portion 22B has the function of holding the position thereof.

The front large diameter portion 22E is, in the axial direction, positioned in the area of the center contact portion 21C of the center terminal 21. That is, the front large diameter portion 22E extends across an area from a front end position of the dielectric body 23 attached to the center terminal 21 to a front end position of the center contact portion 21C.

As seen from FIG. 5C, the external contact portion 22C is positioned in such an area that the external contact portion 22C contacts an external contact portion of the external terminal of the later-described partner connector after having received such a contact portion.

Figure 3:
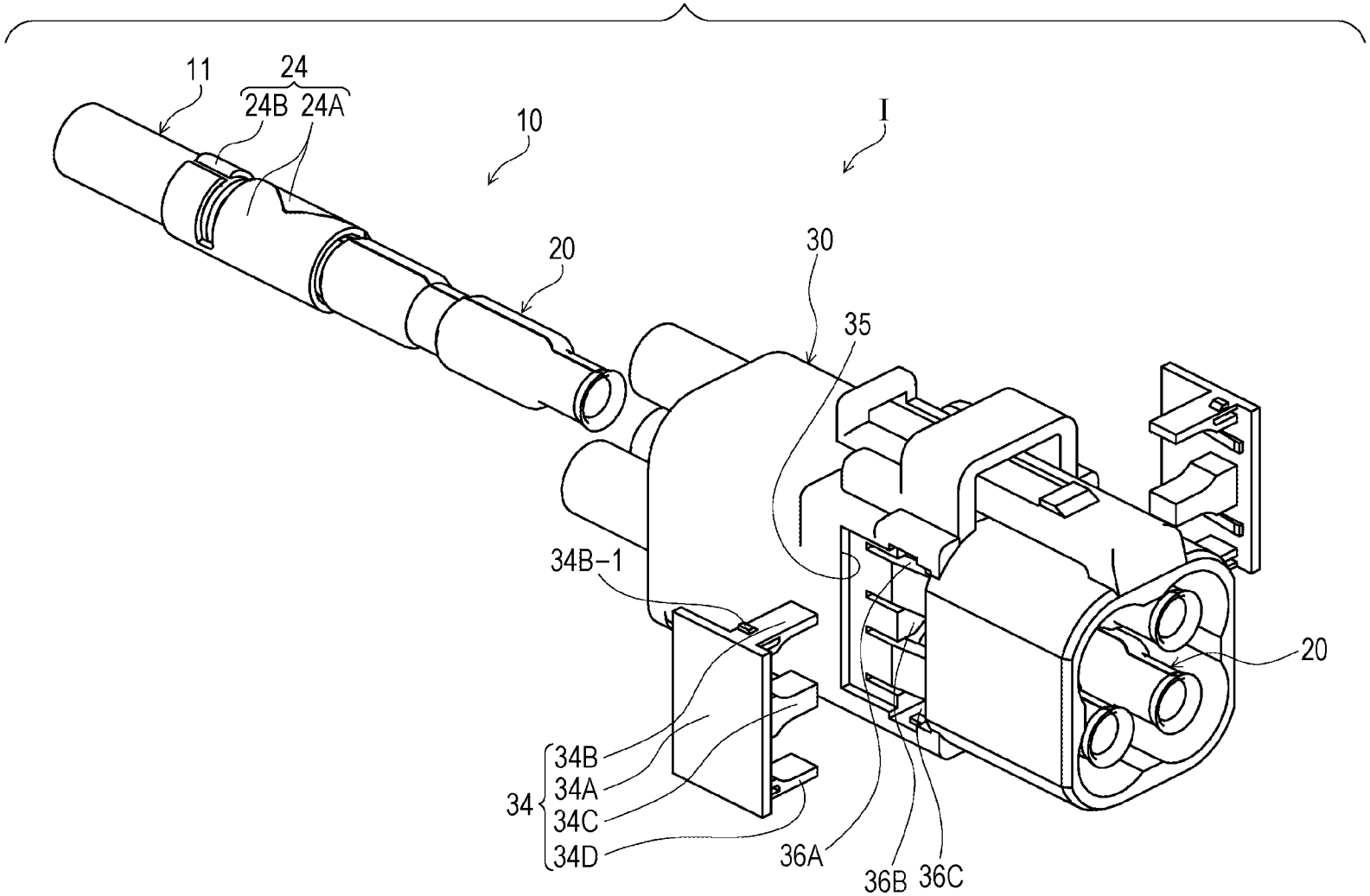
FIG. 3 is a perspective view of retainers before attachment and after only three of four coaxial terminal equipped cables of FIG. 2 have been assembled into a housing in the process of assembling the plug connector of FIG. 1.

As seen from FIG. 3, the external terminal 22 positioned as described above is fixed by the metal fastener 24, and the position of the external terminal 22 is determined by the above-described retainers. The retainer will be further described later together with the housing. The metal fastener 24 is obtained in such a manner that a metal band-shaped plate is bent. The metal fastener 24 is in a substantially U-shape as seen from FIG. 2 in a state before the shield wire 15 and the external terminal 22 are together swaged. Moreover, the metal fastener 24 has a front fastening arm portion 24A positioned at a front portion across a wide area in the axial direction, and a back fastening arm portion 24B positioned at a back portion across a narrow area in the axial direction. As seen from FIG. 3, the front fastening arm portion 24A is swaged and formed in a cylindrical shape such that the shield wire 15 and the external connection portion 22A of the external terminal 22 inserted between the shield wire 15 and the dielectric body 14 are together firmly held and are reliably brought into electric contact with each other.

Meanwhile, the back fastening arm portion 24B is formed in a cylindrical shape in such a manner that the back fastening arm portion 24B is directly swaged to the outer coat 16 of the coaxial cable 11. In this manner, the external terminal 22 is firmly held in connection with the coaxial cable 11 by the metal fastener 24 (see FIG. 3). At the external terminal 22, the external connection portion 22A is not necessarily provided. The portion of the external terminal 22 is only necessary to be connected to the shield wire 15. Moreover, the metal fastener 24 may be formed integrally with the external terminal 22.

As described above, the coaxial terminal 20 of the plug connector I attached to the coaxial cable 11, i.e., the center terminal 21 and the external terminal 22, ensures a specific impedance with respect to a coaxial terminal of the receptacle connector II with the plug connector I being fitted and connected to the later-described receptacle connector II. Such a specific impedance will be described again after description of the receptacle connector II.

In the coaxial terminal equipped cable 10 in a state in which the coaxial terminal 20 of the plug connector I is attached to the coaxial cable 11, the coaxial terminal 20 is housed in the housing 30 made of the electric insulating material, and is held at a predetermined position. In the housing 30 illustrated in FIG. 1, four coaxial terminal equipped cables 10 are collectively housed. FIG. 3 illustrates an assembly process when only one coaxial terminal equipped cable 10 is not assembled yet.

The housing 30 is in a rectangular tubular shape with a substantially rectangular parallelepiped outer shape, the rectangular tubular shape having a substantially square sectional shape perpendicular to the axial direction such that each axes of four coaxial terminal equipped cables 10 parallel with each other are arranged in two tiers and two rows. As seen from FIG. 1, the housing 30 has a tubular support portion 31 at a front portion facing the receptacle connector II. An outer peripheral surface of the tubular support portion 31 is formed as a fitting outer surface 31A to be fitted into an inner peripheral surface of a tubular support portion formed according to a housing of the receptacle connector II. An inner peripheral surface of the tubular support portion 31 is formed as a receiving inner surface 31B configured to receive an outer surface of a shield shell having four continuous partial cylinder outer surfaces of the shield shell positioned in the housing of the receptacle connector II. The receptacle connector II will be described later in detail.

In the tubular support portion 31, the external terminal 22 of the coaxial terminal equipped cable 10 is positioned on a center line of each partial cylinder surface of the receiving inner surface 31B.

The housing 30 of the plug connector I has a lock arm 32 standing at a front end position of an upper outer surface of the tubular support portion 31 and extending backward. The lock arm 32 forms a lock mechanism in combination with a corresponding portion of the receptacle connector II. An inverted U-shaped protection frame 33 is provided at a middle position of an upper outer surface of the housing 30 in the axial direction. The lock arm 32 penetrates an internal space of the protection frame 33, and extends to a position (the left side as viewed in FIG. 1) in the back of the protection frame 33. A locking protrusion 32A for locking is provided at a position in the front of the protection frame 33 on an upper surface of the lock arm 32. An unlocking protrusion 32B for unlocking operation is provided in a protruding shape at a back end position. The locking protrusion 32A has a tapered front surface inclined with respect to the axial direction, and a perpendicular back surface orthogonal to the axial direction.

The position determination portion 22B is provided, as the annular groove portion, at the external terminal 22 of the housing 30 in a middle position in the axial direction, as shown in FIG. 2. Moreover, the housing 30 is configured such that the retainers 34 made of an electric insulating material and having retaining pieces are, at the position of the position determination portion 22B, attached from both sides of the housing 30 to face each other. As seen from FIG. 3 illustrating a state before attachment to the housing 30, both retainers 34 are formed in a symmetrical form in an opposing direction thereof. Both retainers 34 extend in an axial direction area including the area of the position determination portion 22B of the external terminal 22 and an area including an upper-to-lower area of the external terminals 22 of both coaxial terminal equipped cables 10 in the upper and lower tiers. Each retainer 34 includes a rectangular flat plate-shaped retainer body 34A extending across the axial direction area and the upper-to-lower area and three retaining pieces 34B, 34C, 34D extending inward of the housing 30 from the retainer body 34A in the opposing direction. Each retainer body 34A is attached to an attachment window 35 of the housing 30 formed corresponding to such a retainer body 34A. The sizes and set positions of the retaining pieces 34B, 34C, 34D are set such that these retaining pieces are each inserted into insertion grooves 36A, 36B, 36C formed at corresponding positions of the housing 30 and enter toward the annular groove-shaped position determination portions 22B of the above-described two external terminals 22 in the circumferential direction (the tangential direction) thereof. Of these three retaining pieces 34B, 34C, 34D, the upper and lower retaining pieces 34B, 34D are formed thinner than the center retaining piece 34C. The upper retaining piece 34B is in a form symmetrical to the lower retaining piece 34D in the upper-to-lower direction. The upper retaining piece 34B is provided at a position on an upper surface of the position determination portion 22B of the upper external terminal 22. The lower retaining piece 34D is provided at a position on a lower surface of the position determination portion 22B of the lower external terminal 22. The center retaining piece 34C is provided at a position between the position determination portion 22B of the upper external terminal 22 and the position determination portion 22B of the lower external terminal 22.

A lower surface of the upper retaining piece 34B, an upper surface of the lower retaining piece 34D, and both of upper and lower surfaces of the middle retaining piece 34C each have arc surface portions contactable with the outer peripheries of the position determination portions 22B of the external terminals 22. The retainer 34 has a locking protrusion 34B-1 on an upper surface of the upper retaining piece 34B, and has a locking protrusion (not shown) 34D-1 at a lower surface of the lower retaining piece 34D. Moreover, the retainer 34 is locked at protrusions 35A, 35B provided at corresponding positions of the housing 30. Thus, the retainer 34 is less detachable. With this configuration, three retaining pieces 34B, 34C, 34D of each of the retainers 34 attached to the attachment windows 35 of the housing 30 from both sides thereof enter toward the position determination portions 22B of the external terminals 22 of the total of four coaxial terminal equipped cables 10 in two tiers and two rows, and are retained such that the external terminals 22 are held at specified positions in the axial direction and the upper-to-lower direction.

Next, in the receptacle connector II fitted and connected to the plug connector I, a coaxial terminal unit 50 is, at a coaxial terminal portion thereof, housed in the housing 60 made of an electric insulating material, as seen from FIG. 1. As will be described later, the coaxial terminal unit 50 is formed in such a manner that external terminals 55 are each attached to body portions 51 of the coaxial terminal unit 50 and are housed in the shield shell 56. As in the case of the coaxial terminal equipped cables 10 of the plug connector I, four body portions 51 of the coaxial terminal unit 50 arranged in two tiers and two rows are, in the receptacle connector II, also housed in the housing 60 as the coaxial terminal unit 50 configured such that the body portions 51 are collectively held by the metal case-shaped shield shell 56 at front coaxial terminal portions (see FIG. 4).

In the present embodiment, the body portions 51 of the coaxial terminal unit 50 form two types of body portions 51, 51' each configured such that the center terminal 52 is formed integrally with a dielectric body 53. The body portions 51, 51' have the same basic structure, except that the lengths of the dielectric body 53 and the center terminal 52 are different between the body portions 51, 51'. Thus, only one type of body portion 51 with a longer center terminal 52 and a longer dielectric body 53 will be described.

Figure 4:
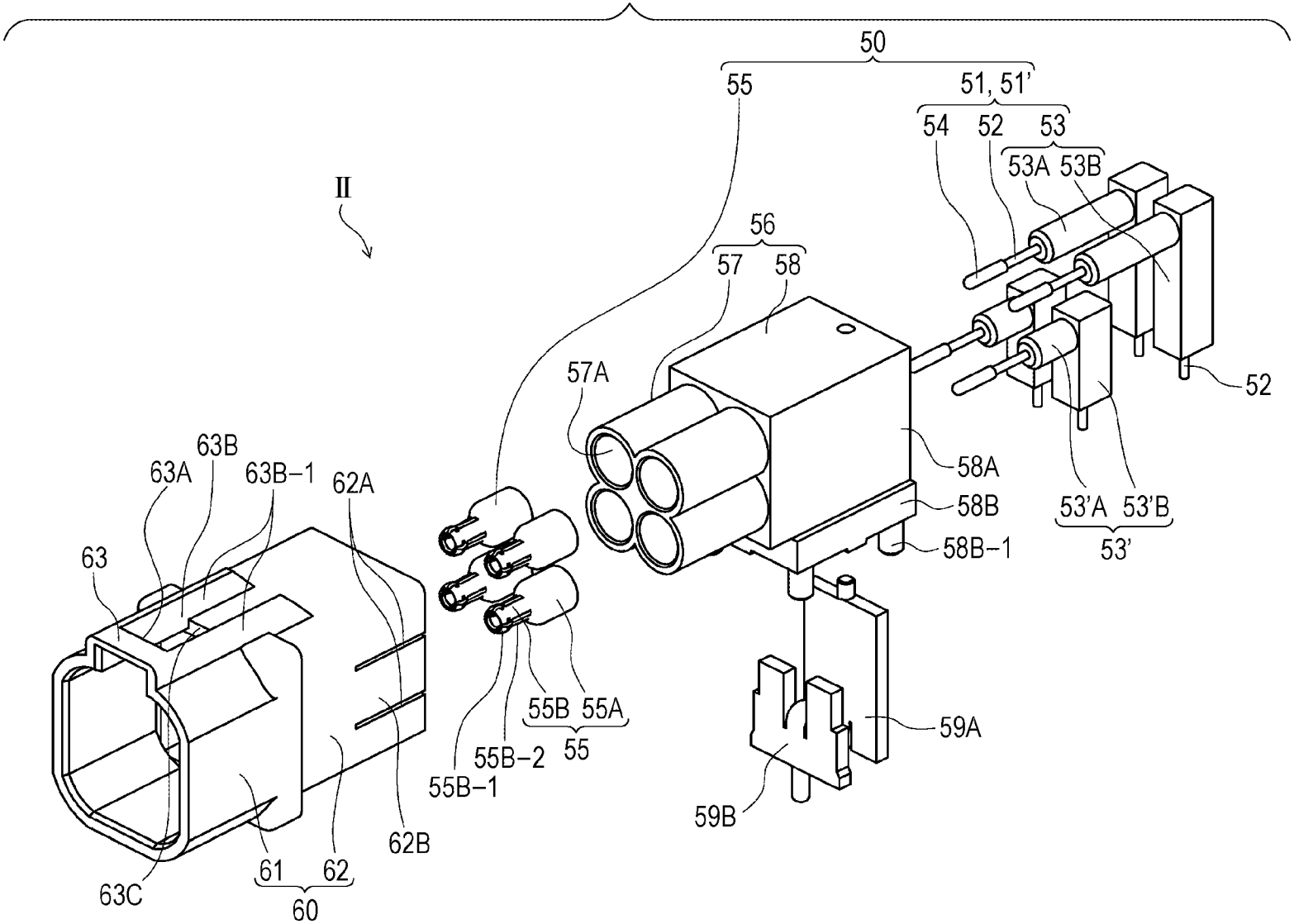
FIG. 4 is a perspective view of each of separated members of the receptacle connector of FIG. 1 before assembly.

As seen from FIG. 4, the center terminal 52 protrudes forward of the dielectric body 53 in the body portion 51 of the coaxial terminal unit 50 of the receptacle connector II in the present embodiment. A front end (one end facing the plug connector I) of the center terminal 52 is formed thicker than other portions, and forms a center contact portion 54. The body portion 51 provided with the center contact portion 54 is housed in the shield shell 56, and forms the coaxial terminal unit 50 in combination with the external terminal 55. As seen from FIG. 4, shield plates 59A, 59B formed of metal plates are attached to the shield shell 56.

Unlike the core wire 13, in the plug connector I, as the strand twisted wire, the center terminal 52 of the body portion 51 is, in the present embodiment, formed as a single core, and is bent in an L-shape as seen from FIG. 5C. As described above, the contact portion 54 formed thicker than other portions is provided at the front end of the center terminal 52.

As seen from FIG. 4, the center terminal 52 bent in the L-shape is configured such that a front end side of a horizontal portion provided with the center contact portion 54 and a lower end side of a vertical portion are exposed through the dielectric body 53. The dielectric body 53 has a cylindrical portion 53A incorporating and holding the horizontal portion of the center terminal 52 other than the above-described front end side, and a rectangular cylindrical portion 53B incorporating and holding the vertical portion of the center terminal 52 other than the lower end side thereof.

Thus, the cylindrical portion 53B integrally hold the cylindrical portion 53A forming the dielectric body 53 and the center terminal 52, thereby forming the body portion 51. On the other hand, in another type of body portion 51', the lengths of the horizontal and vertical portions of the center terminal 52, i.e., the length of a cylindrical portion 53'A of the dielectric body 53 and the length of a rectangular cylindrical portion 53'B of the dielectric body 53, are each shorter than the length of the cylindrical portion 53A and the length of the rectangular cylindrical portion 53B such that front and back end positions of the body portion 51' are coincident with front and back end positions of the center terminal 52 when the body portion 51' is arranged inside (inside a bent portion of a L-shape) of the L-shaped body portion 51.

The external terminal 55 is formed in a stepped cylindrical shape by spinning of a metal plate. A large diameter portion forming the back side as viewed in FIGS. 4 and 5A to 5C forms an exterior base portion 55A as an attachment target portion. A small diameter portion forming the front side forms the external contact portion 55B. The inner diameter of the exterior base portion 55A is slightly greater than the outer diameter of the cylindrical portion 53A of the dielectric body 53. The outer diameter dimension of the exterior base portion 55A is set such that the exterior base portion 55A is press-fitted into a later-described press-fitting portion of the shield shell 56. The external terminal 55 is press-attached to the shield shell 56, thereby forming the coaxial terminal unit 50 in combination with the center terminal 52 of the body portion 51. As seen from FIGS. 5A to 5C, the external contact portion 55B of the external terminal 55 surrounds, without contacting the center terminal 52, the center terminal 52 in an area in the back of the center contact portion 54 when the exterior base portion 55A is press-fitted in the shield shell 56. An annular contact protrusion 55B-1 swelling outward in the radial direction thereof is formed in the vicinity of a front end of the external contact portion 55B. In addition, slits 55B-2 reaching the front end are formed at multiple positions in the circumferential direction. With these multiple slits 55B-2, the diameter of the external contact portion 55B can be elastically expanded in the radial direction. Upon connector fitting, the external contact portion 55B is positioned in the external contact portion 22C of the external terminal 22 of the plug connector I as seen from FIGS. 5A to 5C. In this state, the contact protrusion 55B-1 applies elastic force to an inner surface of the external contact portion 22C while contacting the inner surface. In the external terminal 55, the exterior base portion 55A whose diameter increases in a stepwise manner as compared to the external contact portion 55B is, in the axial direction, positioned to face the front large diameter portion 22E of the external terminal 22 of the plug connector I. The exterior base portion 55A and the front large diameter portion 22E have the substantially same outer diameter (see FIGS. 5A to 5C).

The shield shell 56 housing coaxial terminal portions of the coaxial terminal unit 50 is formed in a case shape by forming a metal material. As seen from FIG. 4, the shield shell 56 includes the tubular support portion 57 forming a front portion, and a box-shaped portion 58 forming a back portion. Both of these portions are integrally formed. When the coaxial terminals 20 and the coaxial terminal unit 50 are fitted and connected together, the tubular support portion 57 extends across the area of such a contact portion in the axial direction. More specifically, as seen from FIGS. 5A to 5C, the tubular support portion 57 extends across an area from the center contact portion 21C of the center terminal 21 to the external contact portion 22C of the external terminal 22 of the plug connector I and an area substantially overlapping with such an area, i.e., an area from the external contact portion 55B of the external terminal 55 to the center contact portion 54 of the receptacle connector II. The tubular support portion 57 has a shape which might be obtained when cylindrical bodies in two tiers and two rows are integrally joined together, and forms four hole-shaped receiving portions 57A having cylindrical inner surfaces. Each receiving portion 57A forms an individual space separated by a partition wall 57A-1 of the tubular support portion 57. Any of these individual spaces communicates with an internal space of the box-shaped portion 58. The partition wall 57A-1 surrounded by four hole-shaped receiving portions 57A formed in two tiers and two rows in the tubular support portion 57 enters to a middle position of the internal space of the box-shaped portion 58 in the axial direction.

The box-shaped portion 58 has a body portion 58A with a substantially cubic outer shape, and an attachment bottom portion 58B. The box-shaped portion 58 opens to the back and lower sides. The attachment bottom portion 58B slightly protrudes to both sides at a bottom portion of the body portion 58A. Such a bottom surface serves as an attachment surface for a circuit board (not shown) and the like. Moreover, attachment legs 58B-1 protruding downward are each provided at corner portions of the bottom portion. The attachment legs 58B-1 are each attached to corresponding holes of the circuit board by, e.g., soldering.

The box-shaped portion 58 is configured such that two types of shield plates 59A, 59B are attached to the box-shaped portion 58 from below. As illustrated in FIG. 5C, the shield plate 59A is attached to the box-shaped portion 58 at a position on the back side of the rectangular cylindrical portion 53B of the dielectric body 53 of one of the body portion 51 of the coaxial terminal unit 50, and covers and shields the internal space of the box-shaped portion 58 on the back side. Moreover, the other shield plate 59B is attached at a position between the rectangular cylindrical portions 53B, 53'B of the dielectric bodies 53, 53' of two types of body portions 51, 51'. An upper end of the shield plate 59B reaches the position of the partition wall 57A-1. Thus, four rectangular cylindrical portions 53B, 53'B of two types of body portions 51, 51' arranged in two tiers and two rows are shielded from each other by two types of shield plates 59A, 59B in the internal space of the box-shaped portion 58. The shield shell 56 and the shield plates 59A, 59B correspond to the shield wire in the plug connector I in terms of shielding of the center terminal.

As seen from FIG. 4, the housing 60 of the receptacle connector II is entirely in a rectangular tubular shape, and integrally has a front tubular portion 61 with its corners rounded and a back tubular portion 62 with corners unrounded. Internal spaces of the front tubular portion 61 and the back tubular portion 62 communicate with each other.

In the front tubular portion 61, a space where the tubular support portion 57 of the shield shell 56 is housed from the back of the front tubular portion 61 is formed. In addition, the front tubular portion 61 has an upper groove wall 63 protruding from an upper wall of the front tubular portion 61 such that a space where the lock arm 32 provided at the housing 30 of the plug connector I is received from the front of the front tubular portion 61 is formed. The upper groove wall 63 extends backward to a middle position of the back tubular portion 62 in the axial direction. A locking portion 63A is formed at a back edge (an edge at a position facing the plug connector I) portion of the upper groove wall 63. Moreover, a lock space 63B penetrating in the upper-to-lower direction is formed in the back of the locking portion 63A. Side portions 63B-1 positioned on both sides of the lock space 63B guide the lock arm 32 back and forth along side surfaces thereof. Two slits 62A are formed at each side surface of the back tubular portion 62. The slits 62A extend to a back end of the back tubular portion 62. An elastic piece 62B is formed between two slits 62A. A locking protrusion 62B-1 to be locked at a back edge of the box-shaped portion 58 of the shield shell 56 is provided on the inside of the back end of the elastic piece 62B (see FIGS. 5A to 5C). Thus, when the housing 60 is fitted onto the shield shell 56, the locking protrusions 62B-1 are locked at a back edge of the shield shell 56. This reduces detachment of the housing 60.

A back edge of the lock space 63B forms a stopper surface 63C. The stopper surface 63C restricts the amount of backward movement of the lock arm 32 relative to a front end of the lock arm 32. Thus, when the plug connector I is fitted in the receptacle connector II, the coaxial terminals 20 and the coaxial terminal unit 50 are fitted and connected together. Meanwhile, the tubular support portion 31 of the housing 30 of the plug connector I enters the front tubular portion 61 of the housing 60 of the receptacle connector II. In such an entrance process, the lock arm 32 intrudes a groove of the upper groove wall 63, and then, advances in the groove. The locking protrusion 32A at the front end of the lock arm 32 comes into contact with the locking portion 63A of the upper groove wall 63. Then, the inclined front surface of the locking protrusion 32A receives downward pressing force from the locking portion 63A, and the lock arm 32 generates downward elastic deflection. Then, the lock arm 32 further advances beyond the locking portion 63A. Immediately after the locking portion 63A has passed the position of the locking portion 63A, the above-described pressing force is released, and the lock arm 32 returns to a state before elastic deflection. A position at which the front end of the lock arm 32 contacts the stopper surface 63C is the most advanced position of the lock arm 32. FIG. 5C illustrates a state when the lock arm 32 is at the most advanced position. When the lock arm 32 attempts to retract from the most advanced position, the perpendicular back surface of the locking protrusion 32A comes into contact with a back surface of the locking portion 63A. This reduces detachment of the connector. Thus, the lock arm 32 and the locking portion 63A form, in a connector fitting state, the lock mechanism between both connectors I, II. As a result, as long as intended detachment operation is not performed, the connectors are less detached from each other even when improper external force acts on the cable. That is, so-called "full lock" is realized (also see FIGS. 5A to 5C).

In the present embodiment, it is set such that a distance (the former) from the front end of the lock arm 32 of the plug connector I to a back end of the locking protrusion 32A provided at the lock arm 32 is shorter than a distance (the latter) from the stopper surface 63C of the receptacle connector II to a front surface of the locking portion 63A. That is, in the connector fitting state, even when the plug connector I and the receptacle connector II are in the fully-locked state, the housings 30, 60 can move relative to each other in a clearance corresponding to a difference between the former distance and the latter distance.

Figure 5A:
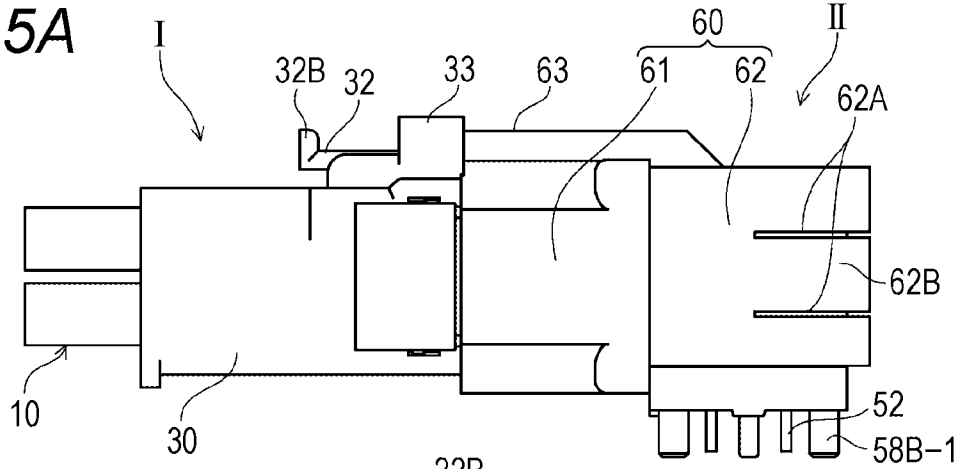
Figure 5C:
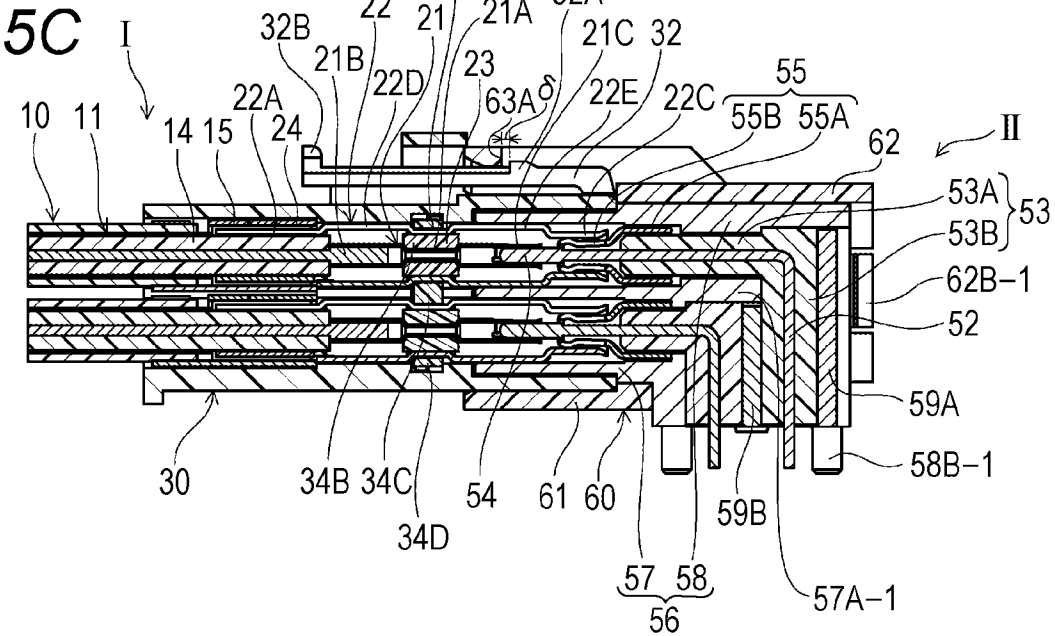
Figure 6B:
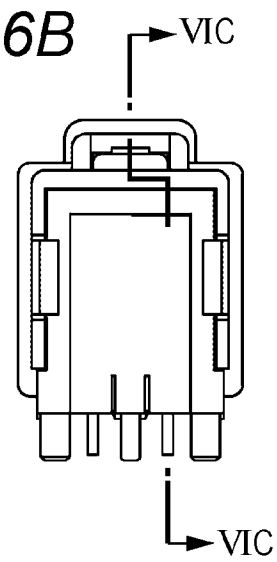
FIGS. 6A to 6C illustrate the coaxial connector assembly (the fitting connection state) of FIG. 1, FIG. 6A being a plan view, FIG. 6B being a side view, and FIG. 6C being a VIC-VIC sectional view of FIG. 6B and illustrating the plug connector at a position having moved backward relative to the receptacle connector from the most advanced position by a clearance.
Figure 6A:
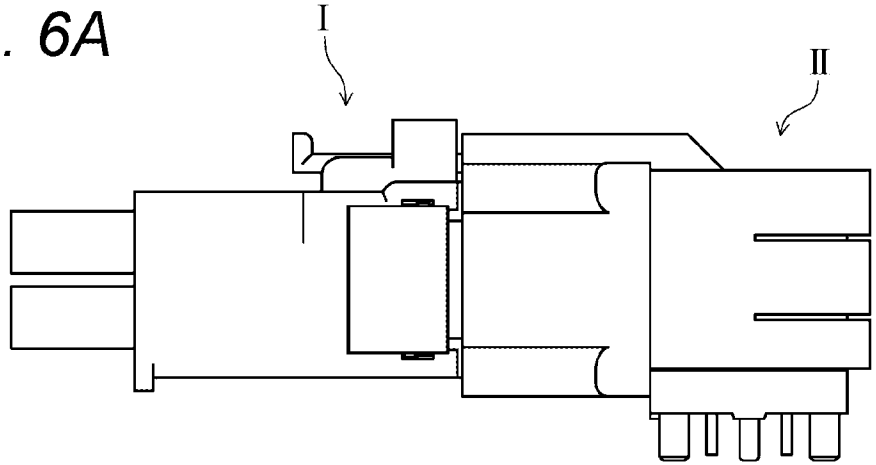
Figure 6C:
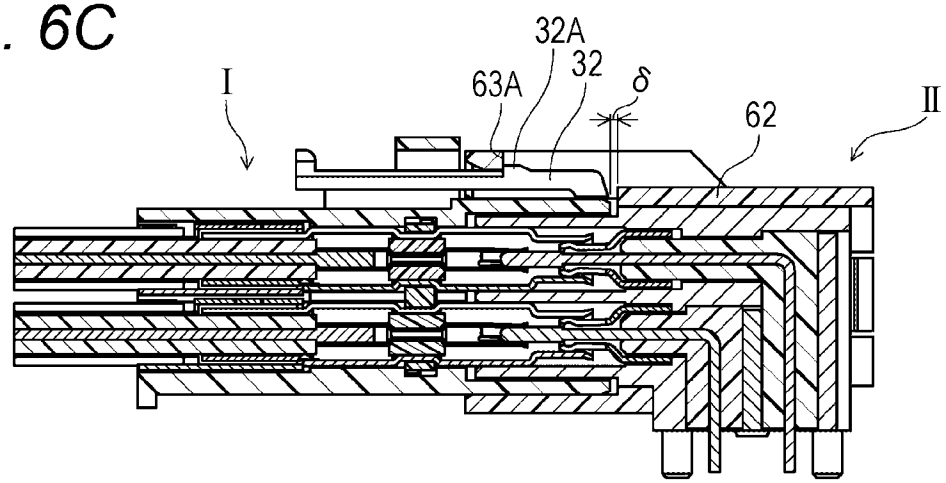

That is, such relative movement is movement from one of an advancing state of the plug connector I as seen from FIGS. 5A and 5C or a retracting state of the plug connector I as seen from FIGS. 6A and 6C to the other one of the advancing state or the retracting state. In the advancing state, the front end of the lock arm 32 of the plug connector I contacts the front tubular portion 61 of the housing 60 of the receptacle connector II. A clearance 8 is formed between the back surface of the locking protrusion 32A of the lock arm 32 and the locking portion 63A of the housing 60. In the retracting state, the locking protrusion 32A of the lock arm 32 contacts the locking portion 63A. A clearance 8 is formed between the front end of the lock arm 32 and the front tubular portion 61. The above-described clearances 8 are necessary for smooth locking of the locking protrusion 32A of the lock arm 32 at the locking portion 63A and unlocking of the locking protrusion 32A from the locking portion 63A by the lock mechanism for generating deflection of the lock arm 32 according to the principle of leverage. In addition, the plug connector I and the receptacle connector II generate unavoidable backlash in the axial direction between each coaxial terminal connected to the cable and the housing. Thus, even when both connectors I, II are in the fitting state, if external force acts on the cable in the axial direction, the contact point position of the coaxial terminal might be shifted in the axial direction by a distance corresponding to the sum of the above-described clearances 8 and the above-described backlash. The maximum acceptable range of such shift is defined as the range of relative movement between the coaxial terminals. That is, both connectors might be shifted in the axial direction between a position illustrated in FIGS. 5A to 5C and a position illustrated in FIGS. 6A to 6C.

Upon fitting connection among the coaxial terminals 20 and the coaxial terminal unit 50 of both connectors I, II, an axial distance (length) from a start position to an end position of contact between both connectors I, II is generally defined as an effective fitting length. That is, in the present embodiment, there are an effective fitting length between the center terminals 21, 52 and an effective fitting length between the external terminals 22, 55. A spacing between the center terminals 21, 52 is herein defined as a center terminal effective fitting length, and a spacing between the external terminals 22, 55 is herein defined as an external terminal effective fitting length. In the present embodiment, the above-described range of relative movement between the coaxial terminals is set smaller than the minimum effective fitting length as a shorter one of the center terminal effective fitting length or the external terminal effective fitting length.

In the present embodiment, the external terminal of the coaxial terminal in one connector of the plug connector I or the receptacle connector II has the external contact portion. Such an external contact portion has a smaller diameter than the diameter of the external terminal in an axial area of the external terminal corresponding to the center contact portion of the center terminal, and extends toward the coaxial terminal in the other connector of the plug connector I or the receptacle connector II from such a corresponding area. The external terminal of the coaxial terminal of the other connector also has the external contact portion. Such an external contact portion has a smaller diameter than the diameter of the exterior base portion fitted onto the dielectric body, and extends to a middle position of the center terminal in the axial direction. The center terminal of the coaxial terminal of the other connector is formed such that the diameter of the center contact portion protruding toward the coaxial terminal of the one connector with respect to the external terminal in the axial direction is greater than the diameter of the portion surrounded by the external contact portion of the coaxial terminal of the other connector. Thus, the impedance between the coaxial terminal 20 and the coaxial terminal unit 50 is, in the direction connector fitting state, matched to the already-described specific impedance in the axial range of the minimum effective fitting length.

Considering with reference to the state of FIGS. 5A to 5C, in a case where the state of FIGS. 5A to 5C turns to the state of FIGS. 6A to 6C in the present embodiment, the position of the external contact portion 22C of the plug connector I and the position of the external contact portion 55B of the receptacle connector II are shifted from each other in the front-to-back direction. However, a distance between the center terminal 52 and the external contact portion 55B does not change. For this reason, impedance matching is held at such a portion. At the same time, when the position of the center contact portion 21C and the position of the center contact portion 54 are shifted from each other in the front-to-back direction, a fitting portion of the center contact portion 54 in FIGS. 5A to 5C is exposed in FIGS. 6A to 6C. However, the region of the protruding center contact portion 54 facing the external contact portion 22C is merely increased, the center contact portion 54 corresponding to the inner diameter of the external contact portion 22C and having a greater diameter than the diameter of the center terminal 52. Thus, impedance matching is also held at such a portion. In the coaxial connector assembly of the present disclosure configured as described above, each member is attached in the following manner to form the coaxial terminal equipped cable, and the coaxial terminals are further fitted and connected together. In this manner, the connector assembly of the present embodiment assembled as described above is used.

First, for the plug connector I, the center terminal 21 and the external terminal 22 are attached to the coaxial cable 11 illustrated in FIG. 2. Next, the cable is fastened by the fastener 24. In this manner, the coaxial terminal equipped cable 10 having the coaxial terminal 20 as illustrated in FIG. 3 is obtained.

As seen from FIG. 3, four prepared coaxial terminal equipped cables 10 are subsequently assembled into the housing 30, the coaxial terminal equipped cables 10 being arranged in two tiers and two rows. Thereafter, the retainers 34 are attached to the housing 30 from both sides. Subsequently, the retaining pieces 34B, 34C, 34D of the retainers are used to determine the position of each coaxial terminal equipped cable 10 with respect to the external terminal 22 thereof in the radial direction and the axial direction. In this manner, the plug connector I illustrated in FIG. 1 is obtained.

Next, for the receptacle connector II, two of each type of body portion 51, 51', i.e., the total of four body portions 51, 51', are assembled into the shield shell 56 from the back thereof. At this point, each center contact portion 54 is assembled in order to be positioned in each hole-shaped receiving portion 57A of the shield shell 56. In such an assembly state, the dielectric bodies 53, 53' of the body portions 51, 51' are positioned in the internal space of the box-shaped portion 58 as the back portion of the shield shell 56. Thereafter, each external terminal 55 is press-fitted in the receiving portions 57A of the shield shell 56 to surround each center contact portion 54. In this manner, the center contact portions 54 and the external terminals 55 form the coaxial terminal.

After the body portions 51, 51' have been assembled into the shield shell 56, the shield plates 59A, 59B are attached to the shield shell 56 from below, and the rectangular cylindrical portions 53B, 53'B of the body portions 51, 51' are shielded.

The housing 60 is attached to the shield shell 56 into which the coaxial terminal unit 50 is assembled as described above. The locking protrusions 62B-1 provided at a back end of the housing 60 are locked at the back edge of the shield shell 56. Thus, the housing 60 is less detached from the shield shell 56. In this manner, the receptacle connector II illustrated in FIG. 1 is obtained. The attachment legs 58B-1 of the receptacle connector II are each inserted into the corresponding holes of the circuit board. In this manner, the positions of the attachment legs 58B-1 are determined. Lower ends of the center terminals 52 are soldered and connected to corresponding circuit portions of the circuit board.

Upon usage of a connector connection, both housings 30, 60 of the plug connector I and the receptacle connector II are fitted together. In such fitting, the lock arm 32 of the plug connector I first enters the groove of the upper groove wall 63 provided at the housing 60 of the receptacle connector II. In this process, the locking protrusion 32A of the lock arm 32 receives the pressing force from the upper groove wall 63. Accordingly, the lock arm 32 generates elastic deflection. Eventually, the locking protrusion 32A passes the locking portion 63A. At this point, fitting connection between both connectors I, II is completed. That is, the coaxial terminals 20 of the plug connector I and the coaxial terminal unit 50 of the receptacle connector II are in a connection state. This realizes the fully-locked state for reducing detachment of both connectors I, II. Even in this fitting connection state, both connectors I, II have the already-described relative movement range. Thus, in response to external force, both connectors might move relative to each other in the axial direction within such a range. This means that there is a probability that the coaxial terminals 20 and the coaxial terminal unit 50 also move relative to each other in this range. However, in the present embodiment, the impedance between the coaxial terminals is matched to have the specific impedance in the above-described relative movement range. Thus, electric properties upon connector connection are not influenced at all.

Figure 7:
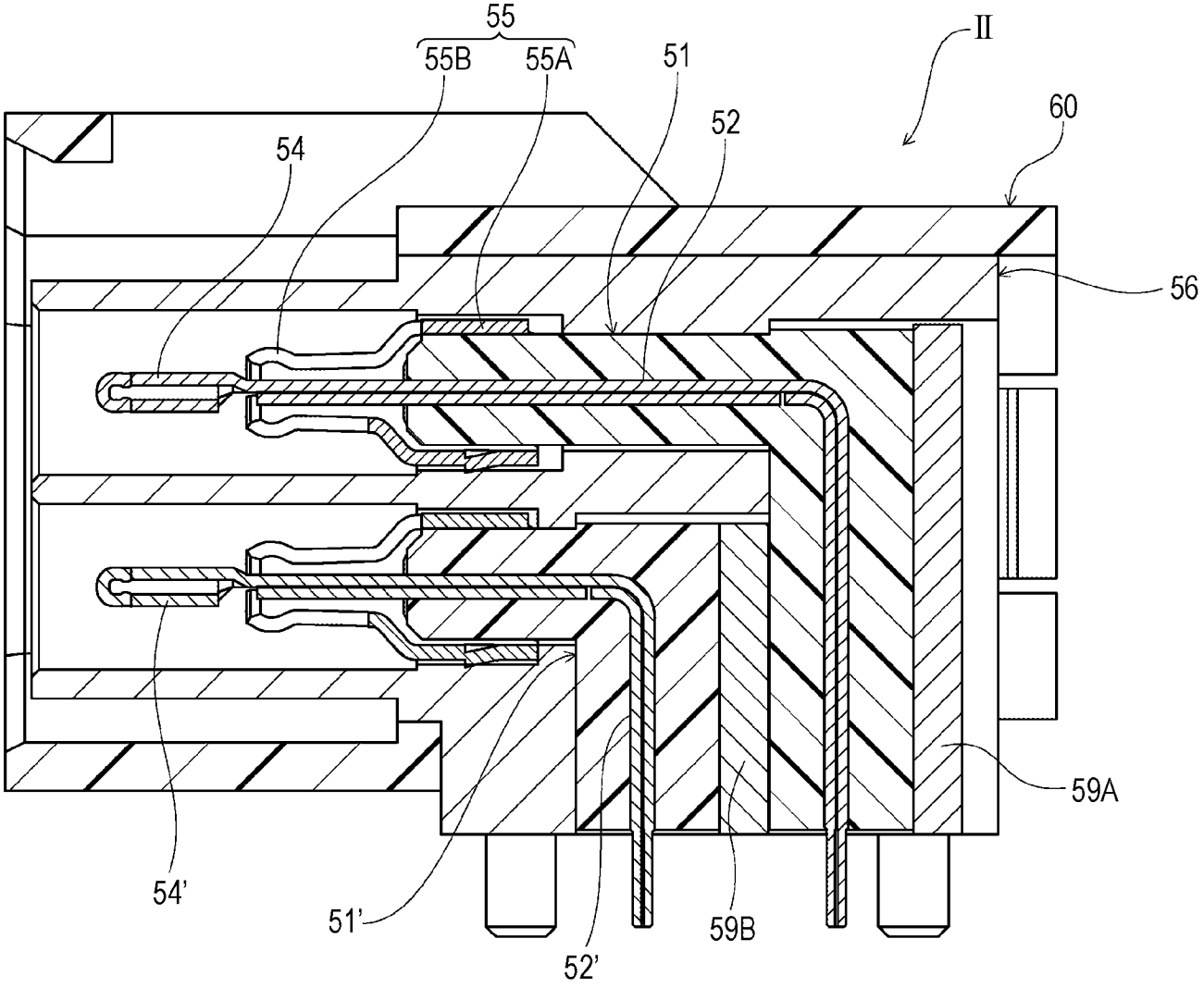
FIG. 7 is a sectional view of a receptacle connector as another embodiment of the present disclosure.

The present embodiment is not limited to the embodiments illustrated in FIGS. 1 to 6A to 6C or the above-described form. Various modifications can be made to the illustrated and described embodiments. In FIG. 7 illustrating a variation, the center terminal 52 of the body portion 51 of the coaxial terminal unit 50 of the receptacle connector II is formed as a core having substantially equal width and thickness in such a manner that a long thin metal band-shaped material is folded in half. Moreover, a front end portion of the center terminal 52 forms the center contact portion 54. Further, the center contact portion 54 is formed integrally with the center terminal 52.

The front end portion of the center terminal 52 forms the center contact portion 54 in such a manner that a band-shaped material is folded by bending from the front to the back. A back portion of the center terminal 52 with respect to the center contact portion 54 is folded by bending in a width direction (a direction perpendicular to the plane of paper of FIG. 7) of the band-shaped material.

The embodiment of FIG. 7 has such a characteristic that the center terminal 52 and the center contact portion 54 are integrally formed of the metal band-shaped material. Other characteristics are the same as those of the above-described embodiment. Thus, the same reference numerals as those of the above-described figures are used in FIG. 7, and description thereof will not be repeated.

Further, in the above-described embodiment, at least one of the plug connector or the receptacle connector is a cable connector. Specifically, the above-described embodiment describes an example where the plug connector is the cable connector. However, the present disclosure is not limited to above, and the receptacle connector may be the cable connector. Alternatively, both connectors may be the cable connectors. For example, in a case where the illustrated receptacle connector II is the cable connector, the receptacle connector II has such a structure that a back portion of the external terminal 55 is combined with the front large diameter portion 22E of the external terminal 22 of the plug connector. The structure of the back tubular portion 62 of the housing 60 of the receptacle connector II is similar to a back structure of the plug connector I with respect to the retainers 34. That is, the cable connector employing the structure of the plug connector other than the fitting portion and the lock portion is realized.

The coaxial connector assembly of the present disclosure may be the following first to seventh coaxial connector assemblies.

The first coaxial connector assembly is a coaxial connector assembly including a plug connector and a receptacle connector each configured to hold, at a housing of an electric insulating material, a coaxial terminal including a center terminal of a coaxial cable and an external terminal surrounding the center terminal, at least one of the plug connector or the receptacle connector being a cable connector. In this coaxial connector assembly, the housing of the plug connector and the housing of the receptacle connector have a disengageable lock mechanism configured to engage at a predetermined fitting position between the housings to suppress detachment. In a lock state, the range of relative movement between the coaxial terminals in an axial direction as a coaxial terminal insertion/detachment direction is set smaller than the minimum effective fitting length as a shorter one of a center terminal effective fitting length or an external terminal effective fitting length defined as a distance from a start position of contact between the center terminals or the external terminals at the start of fitting between the coaxial terminals to an end position of contact at the end of fitting. The axial direction range of the minimum effective fitting length is matched to a specific impedance.

The second coaxial connector assembly is the first coaxial connector assembly in which the external terminal of the coaxial terminal in a one connector as one of the plug connector or the receptacle connector has an external contact portion having a smaller diameter than that in an axial area corresponding to a center contact portion of the center terminal and extending toward the coaxial terminal in a the other connector as the other one of the plug connector or the receptacle connector from the corresponding area, the external terminal of the coaxial terminal of the other connector has an external contact portion having a smaller diameter than that of an exterior base portion fitted onto a dielectric body and extending to a middle position of the center terminal in the axial direction, and the center terminal of the coaxial terminal of the other connector is formed such that the diameter of the center contact portion protruding toward the coaxial terminal of the one connector with respect to the external terminal in the axial direction is greater than that of a portion surrounded by the external contact portion of the coaxial terminal of the other connector.

The third coaxial connector assembly is the first or second coaxial connector assembly in which the range of relative movement between the coaxial terminals of the plug connector and the receptacle connector is a range determined by the sum of a clearance between the housings in the axial direction in both connector lock state and backlash in the axial direction between each housing and the corresponding external terminal thereof.

The fourth coaxial connector assembly is any one of the first to third coaxial connector assemblies in which the plug connector and the receptacle connector house multiple coaxial terminals.

The fifth coaxial connector assembly is any one of the first to fourth coaxial connector assemblies in which the receptacle connector has a metal shield shell in the housing of the receptacle connector, the shield shell is formed to collectively house multiple center terminals, multiple dielectric bodies, and multiple external terminals, and the shield shell is configured such that a connector fitting side portion thereof enters, in a fitting state between the receptacle connector and the plug connector, the housing of the plug connector to contact the external terminal of the plug connector.

The sixth coaxial connector assembly is the fifth coaxial connector assembly in which the shield shell has a support tubular portion surrounding and supporting each external terminal of the receptacle connector in a separated state.

The seventh coaxial connector assembly is any one of the first to fifth coaxial connector assemblies in which the plug connector has a retainer configured to determine the position of each coaxial terminal.

What is claimed is:

1. A coaxial connector assembly comprising:

a plug connector and a receptacle connector each configured to hold, at a housing of an electric insulating material, a coaxial terminal including a center terminal of a coaxial cable and an external terminal surrounding the center terminal, wherein at least one of the plug connector or the receptacle connector is a cable connector, the housing of the plug connector and the housing of the receptacle connector have an engageable/disengageable lock mechanism at a predetermined fitting position between the housings, in an engagement state, the center terminal of the plug connector is in direct contact with the center terminal of the receptacle connector, the external terminal of the plug connector is in direct contact with the external terminal of the receptacle connector, and a range of relative movement between the coaxial terminals in an axial direction as a coaxial terminal insertion/detachment direction is smaller than a minimum effective fitting length, the minimum effective fitting length is a shorter one of a center terminal effective fitting length or an external terminal effective fitting length, the center terminal effective fitting length is a distance from a start position of direct contact between the center terminals at a start of fitting between the coaxial terminals to an end position of direct contact between the center terminals at an end of fitting between the coaxial terminals, the external terminal effective fitting length is a distance from a start position of direct contact between the external terminals at the start of fitting between the coaxial terminals to an end position of direct contact between the external terminals at the end of fitting between the coaxial terminals, an impedance in the axial direction range of the minimum effective fitting length is matched to a specific impedance, and the center terminal of the coaxial terminal in one connector of the plug connector or the receptacle connector comprises:

an exposed portion that is exposed from the external terminal of the coaxial terminal in the one connector of the plug connector or the receptacle connector, and an unexposed portion that is covered with the external terminal of the coaxial terminal in the one connector of the plug connector or the receptacle connector, and a diameter of the exposed portion is greater than a diameter of the unexposed portion.

2. The coaxial connector assembly according to claim 1, wherein the external terminal of the coaxial terminal in other connector of the plug connector or the receptacle connector has a first external contact portion that is in direct contact with the external terminal of the coaxial terminal in the one connector of the plug connector or the receptacle connector, the first external contact portion has a smaller diameter than a diameter of the external terminal in an axial area of the external terminal corresponding to a center contact portion of the center terminal, and extends toward the coaxial terminal in the one connector of the plug connector or the receptacle connector from the corresponding area, the external terminal of the coaxial terminal of the one connector has a second external contact portion that is in direct contact with the external terminal of the coaxial terminal in the other connector of the plug connector or the receptacle connector, and the second external contact portion has a smaller diameter than a diameter of an exterior base portion fitted onto a dielectric body, and extends to a middle position of the center terminal in the axial direction.

3. The coaxial connector assembly according to claim 1, wherein the range of relative movement between the coaxial terminals is a sum of a clearance between the housings in the axial direction in a connector lock state and backlash in the axial direction between each housing and the corresponding external terminal.

4. The coaxial connector assembly according to claim 1, wherein the coaxial terminal includes multiple coaxial terminals housed in each of the plug connector and the receptacle connector.

5. The coaxial connector assembly according to claim 1, wherein the receptacle connector has a metal shield shell in the housing of the receptacle connector, the center terminal includes multiple center terminals, the dielectric body includes multiple dielectric bodies, and the external terminal includes multiple external terminals, the shield shell is formed to collectively house the center terminals, the dielectric bodies, and external terminals, and the shield shell is configured such that a connector fitting side portion thereof enters, in a fitting state between the receptacle connector and the plug connector, the housing of the plug connector to contact the external terminal of the plug connector.

6. The coaxial connector assembly according to claim 5, wherein the shield shell has a support tubular portion surrounding and supporting each external terminal of the receptacle connector in a separated state.

7. The coaxial connector assembly according to claim 1, wherein the plug connector has a retainer configured to determine an arrangement position of each coaxial terminal.

8. The coaxial connector assembly according to claim 1, wherein the external terminal of the coaxial terminal in other connector of the plug connector or the receptacle connector has a first external contact portion that is in direct contact with the external terminal of the coaxial terminal in the one connector of the plug connector or the receptacle connector, and the first external contact portion has a smaller diameter than a diameter of the external terminal in an axial area of the external terminal corresponding to a first center contact portion of the center terminal of the coaxial terminal in the other connector, extends toward the coaxial terminal in the one connector of the plug connector or the receptacle connector beyond the center terminal of the coaxial terminal in the other connector, and internally houses the external terminal of the coaxial terminal in the one connector.

9. The coaxial connector assembly according to claim 8, wherein the exposed portion is in direct contact with the center terminal of the coaxial terminal in the other connector of the plug connector or the receptacle connector.

10. The coaxial connector assembly according to claim 1, wherein the external terminal of the coaxial terminal in the one connector of the plug connector or the receptacle connector comprises:

a small diameter portion at a front side of the external terminal in a direction in which the plug connector and the receptacle connector approach each other; and a large diameter portion at a back side of the external terminal having a diameter larger than a diameter of the small diameter portion, and the small diameter portion is inserted into the external terminal of the coaxial terminal in other connector of the plug connector or the receptacle connector.

11. The coaxial connector assembly according to claim 1, wherein in the engagement state, the center terminal of the coaxial terminal in other connector of the plug connector or the receptacle connector receives the center terminal of the coaxial terminal in the one connector of the plug connector or the receptacle connector.

12. The coaxial connector assembly according to claim 1, wherein in the engagement state, the external terminal of the coaxial terminal in other connector of the plug connector or the receptacle connector receives the external terminal of the coaxial terminal in the one connector of the plug connector or the receptacle connector.

13. A coaxial connector assembly comprising:

a plug connector and a receptacle connector each configured to hold, at a housing of an electric insulating material, a coaxial terminal including a center terminal of a coaxial cable and an external terminal surrounding the center terminal, wherein at least one of the plug connector or the receptacle connector is a cable connector, the housing of the plug connector and the housing of the receptacle connector have an engageable/disengageable lock mechanism at a predetermined fitting position between the housings, in an engagement state, the center terminal of the plug connector is in direct contact with the center terminal of the receptacle connector, the external terminal of the plug connector is in direct contact with the external terminal of the receptacle connector, and a range of relative movement between the coaxial terminals in an axial direction as a coaxial terminal insertion/detachment direction is smaller than a minimum effective fitting length, the minimum effective fitting length is a shorter one of a center terminal effective fitting length or an external terminal effective fitting length, the center terminal effective fitting length is a distance from a start position of direct contact between the center terminals at a start of fitting between the coaxial terminals to an end position of direct contact between the center terminals at an end of fitting between the coaxial terminals, the external terminal effective fitting length is a distance from a start position of direct contact between the external terminals at the start of fitting between the coaxial terminals to an end position of direct contact between the external terminals at the end of fitting between the coaxial terminals, an impedance in the axial direction range of the minimum effective fitting length is matched to a specific impedance, the receptacle connector has a metal shield shell in the housing of the receptacle connector, the center terminal includes multiple center terminals, the dielectric body includes multiple dielectric bodies, and the external terminal includes multiple external terminals, the shield shell is formed to collectively house the center terminals, the dielectric bodies, and external terminals, and the shield shell is configured such that a connector fitting side portion thereof enters, in a fitting state between the receptacle connector and the plug connector, the housing of the plug connector to contact the external terminal of the plug connector.

14. The coaxial connector assembly according to claim 13, wherein the external terminal of the coaxial terminal in one connector of the plug connector or the receptacle connector has a first external contact portion that is in direct contact with the external terminal of the coaxial terminal in other connector of the plug connector or the receptacle connector, the first external contact portion has a smaller diameter than a diameter of the external terminal in an axial area of the external terminal corresponding to a center contact portion of the center terminal, and extends toward the coaxial terminal in the other connector of the plug connector or the receptacle connector from the corresponding area, the external terminal of the coaxial terminal of the other connector has a second external contact portion that is in direct contact with the external terminal of the coaxial terminal in the one connector of the plug connector or the receptacle connector, the second external contact portion has a smaller diameter than a diameter of an exterior base portion fitted onto a dielectric body, and extends to a middle position of the center terminal in the axial direction, and the center terminal of the coaxial terminal of the other connector is formed such that a diameter of the center contact portion protruding toward the coaxial terminal of the one connector with respect to the external terminal in the axial direction is greater than a diameter of a portion surrounded by the external contact portion of the coaxial terminal of the other connector.

15. The coaxial connector assembly according to claim 13, wherein the range of relative movement between the coaxial terminals is a sum of a clearance between the housings in the axial direction in a connector lock state and backlash in the axial direction between each housing and the corresponding external terminal.

16. The coaxial connector assembly according to claim 13, wherein the shield shell has a support tubular portion surrounding and supporting each external terminal of the receptacle connector in a separated state.

17. The coaxial connector assembly according to claim 13, wherein the plug connector has a retainer configured to determine an arrangement position of each coaxial terminal.

18. The coaxial connector assembly according to claim 13, wherein the external terminal of the coaxial terminal in one connector of the plug connector or the receptacle connector has a first external contact portion that is in direct contact with the external terminal of the coaxial terminal in other connector of the plug connector or the receptacle connector, and the first external contact portion has a smaller diameter than a diameter of the external terminal in an axial area of the external terminal corresponding to a first center contact portion of the center terminal of the coaxial terminal in the one connector, extends toward the coaxial terminal in the other connector of the plug connector or the receptacle connector beyond the center terminal of the coaxial terminal in the one connector, and internally houses the external terminal of the coaxial terminal in the other connector.

19. The coaxial connector assembly according to claim 13, wherein the center terminal of the coaxial terminal in the other connector has a second center contact portion that is in direct contact with the center terminal of the coaxial terminal in the one connector of the plug connector or the receptacle connector, and the second center contact portion has a larger diameter than a diameter of other portions of the center terminal of the coaxial terminal in the other connector, and extends toward the coaxial terminal in the one connector beyond the external terminal of the coaxial terminal in the other connector.

20. The coaxial connector assembly according to claim 13, wherein the external terminal of the coaxial terminal in one connector of the plug connector or the receptacle connector comprises:

a small diameter portion at a front side of the external terminal in a direction in which the plug connector and the receptacle connector approach each other; and a large diameter portion at a back side of the external terminal having a diameter larger than a diameter of the small diameter portion, and the small diameter portion is inserted into the external terminal of the coaxial terminal in other connector of the plug connector or the receptacle connector.

* * * * *